US005502120A

United States Patent [19]

Bhatt et al.

[11] Patent Number: 5,502,120

[45] Date of Patent: Mar. 26, 1996

[54] MELT-EXTRUDED MONOFILAMENT COMPRISED OF A BLEND OF POLYETHYLENE TEREPHTHALATE AND A THERMOPLASTIC POLYURETHANE

[75] Inventors: Girish M. Bhatt, S. Burlington, Vt.; Dale B. Johnson, Ottawa, Canada

[73] Assignee: JWI Ltd., Kanata, Canada

[21] Appl. No.: 285,740

[22] Filed: Aug. 4, 1994

Related U.S. Application Data

[63] Continuation-in-part of Ser. No. 34,207, Mar. 19, 1993, abandoned, which is a continuation of Ser. No. 701,752, May 17, 1991, abandoned, which is a continuation of Ser. No. 324,614, Mar. 17, 1989, abandoned, which is a continuation-in-part of Ser. No. 228,447, Aug. 5, 1988, abandoned.

[51] Int. Cl.[6] ..... D01F 6/92

[52] U.S. Cl. ..... 525/440; 524/539

[58] Field of Search ..... 525/440; 524/539

[56] References Cited

U.S. PATENT DOCUMENTS

| | | |
|---|---|---|
| 2,968,857 | 1/1961 | Swerdloff et al. . |
| 3,448,172 | 6/1969 | Damusis et al. . |
| 3,761,348 | 9/1973 | Chamberlin . |
| 3,904,706 | 9/1975 | Hoeschele . |
| 3,987,141 | 10/1976 | Martin . |
| 4,071,050 | 1/1978 | Codorniu . |
| 4,129,611 | 11/1978 | Heiss . |
| 4,156,702 | 5/1979 | Edinger . |
| 4,167,541 | 9/1989 | Alexander . |
| 4,279,801 | 7/1981 | Kramer . |
| 4,663,221 | 5/1987 | Makimura . |
| 4,915,893 | 10/1990 | Gogolewski . |
| 5,108,837 | 4/1992 | Tung . |

FOREIGN PATENT DOCUMENTS

| | | |
|---|---|---|
| 232708 | 8/1987 | European Pat. Off. . |
| 245851 | 11/1987 | European Pat. Off. . |
| 61-132627 | 6/1986 | Japan . |
| 61-186576 | 8/1986 | Japan . |
| 61-21820 | 1/1987 | Japan . |
| 8301253 | 4/1983 | WIPO . |
| 8400303 | 2/1984 | WIPO . |
| 8704198 | 7/1987 | WIPO . |

*Primary Examiner*—Patricia A. Short
*Attorney, Agent, or Firm*—Robert A. Wilkes

[57] ABSTRACT

This invention discloses a fiber suitable for a papermaker's forming fabric, comprising a blend of 60 to 90% by weight of a polyethylene terephthalate, together with 40 to 10% by weight of a thermoplastic polyurethane, which may be an ester or ether-based type. Additionally, it is contemplated that the blend may contain up to 5% by weight of a hydrolysis stabilizer. The high abrasion resistance of these blended monofilaments makes them particularly advantageous for use in replacing the nylon-6 and nylon-66 monofilaments currently used in paper machine forming fabrics.

27 Claims, 1 Drawing Sheet

MELT-EXTRUDED MONOFILAMENT COMPRISED OF A BLEND OF POLYETHYLENE TEREPHTHALATE AND A THERMOPLASTIC POLYURETHANE

This application is a continuation-in-part of application Ser. No. 08/034,207 filed on Mar. 19, 1993, now abandoned, which is a continuation of application Ser. No. 07/701,752 filed on May 17, 1991, now abandoned, which is a continuation of application Ser. No. 07/324,614 filed on Mar. 17, 1989, now abandoned, which is a continuation-in-part of application Ser. No. 07/228,447, filed on Aug. 5, 1988, now abandoned.

BACKGROUND OF THE INVENTION

This invention relates to a melt-extruded monofilament having improved abrasion resistance, wet-to-dry dimensional stability, and crimpability properties. The monofilament is particularly suitable for use in the manufacture of papermaking machine forming fabrics.

FIELD OF THE INVENTION

In a papermaking machine, a continuous sheet of paper or paper-like material is formed by flowing a water-based slurry of cellulosic fibers onto a travelling continuous woven belt, known in the trade as a "forming fabric". As the slurry travels on the continuous belt, it is transformed into a wet paper web which is largely self-supporting by removing from it much of the water in the initial slurry. A typical slurry as delivered to the moving forming fabric can contain as little as 0.5% by weight of cellulosic fibers, can range in temperature from about 30° C. to about 85° C., and typically has a pH of from 4 to 9. The wet paper web leaving the so-called forming section to pass to the press and dryer sections can still contain 80% water by weight.

After leaving the forming section over a couch roll, the web is transferred to a press section where a major proportion of the remaining water is removed by passing it through a series of pressure nips in sequence. On leaving the press section, the web passes to a heated dryer section for final drying. The dried web can then be calendered, to smooth the surface, and then finally collected on a reel.

As the wet slurry travels along on the forming fabric, water removal is enhanced by the use of hydrofoils, table rolls, and suction boxes.

This invention is directly concerned with monofilaments which are particularly suitable for the manufacture of papermaking forming fabrics intended for use in the forming section of a papermaking machine. These fabrics are used to screen a moisture-laden mass of cellulose fibers during the initial stage of water removal and transform it into a wet paper web.

In the original Fourdrinier papermaking machines, the forming fabric comprised a structure woven from metal wire, as a result of which these fabrics came to be known as fourdrinier wires. The preferred metal for these wires was phosphor-bronze. These fourdrinier wires were used in all kinds of papermaking machines, and for all qualities of paper. Whilst effective, these wires were not without disadvantages, especially as regards their abrasion resistance capabilities when the cellulosic fiber slurry also contained abrasive fillers such as silica and calcium carbonate.

Of recent times, these wire fabrics have been replaced with fabrics based on synthetic plastic fibers, which commonly are monofilaments. Since the ultimate basis of good quality paper lies in the forming fabric itself, the structure and properties of the forming fabric are of vital importance. The major advantage offered by the fabrics based on synthetic plastic monofilaments over the phosphor-bronze wire fabrics is an improved abrasion resistance, which has led to an average improvement in fabric life of over four times that of the wire fabrics. But these fabrics are still prone to abrasion by the same sorts of fillers as caused problems with the older phosphor-bronze wires. For a paper machine forming fabric to be successful, it must desirably possess the following characteristics:

(i) it must be resistant to abrasion, both by rubbing contact with machine parts and by contact with solids in the cellulose fiber-water slurry;

(ii) it must be structurally stable in the plane of the fabric, in order to cope with the stresses imposed on it in use;

(iii) it must resist any dimensional changes in the plane of the fabric due to moisture absorption over a wide range of moisture contents, since when the machine is running it will be fully wet, and when the machine is stopped for any length of time it will dry out;

(iv) it must resist stretch under the tension imposed by the powered rolls which drive the fabric in a paper making machine; and (v) it must be resistant to degradation by the various materials present both in the cellulose fiber-water slurry, and in materials used to clean the forming fabric, at the prevailing temperature of use.

No known fabric, not even the long-used phosphor-bronze fourdrinier wires, exhibits perfectly all of these characteristics. For example, as noted above, the phosphor-bronze wires do not resist abrasion as much as is desirable. Not even the available synthetic plastic monofilaments will provide fabrics meeting all of these requirements to the sort of level that a papermaker desires. The synthetic polymers which provide the currently most acceptable monofilaments used in making forming fabrics are polyester, particularly polyethylene terephthalate, and polyamide, particularly nylon-6 (polycaprolactam) and nylon-66 (Poly-hexamethyleneadipamide). These polymers have been mixed with others, such as polyethylene and polyesters based on polybutylene terephthalate, but still such fabrics are far from perfect. The major difficulties essentially are two:

(a) whilst polyethylene terephthalate shows more than adequate chemical and dimensional stability, and also is amenable to weaving, having good crimpability, and exhibiting good heat set behaviour, its abrasion resistance leaves something to be desired, especially with higher speed modern machines, and (b) whilst nylon-6 and nylon-66 show adequate abrasion resistance, they have serious deficiencies for weaving as they have very poor crimpability and inadequate heat set behaviour, and they possess neither adequate dimensional stability in the moisture range found in the papermaking environment, nor adequate resistance to some of the materials used in cleaning forming fabrics.

The inherent dimensional instability of nylon-6 and nylon-66 in the range of moisture contents found in the papermaking environment, running from fully wet to dry, imposes a restriction on the ratio of the number of nylon monofilaments to polyethylene terephthalate monofilaments which may be successfully used in forming fabrics. This ratio is cited as being 50% in both U.S. Pat. Nos. 4,529,013 and 4,289,173; West German OS 2,502,466 similarly gives a figure of 50%, and additionally suggests that the nylon filaments should have at least 4% (the maximum recommended is 25%) larger diameter than the polyester monofilaments. Attempts to circumvent this difficulty by improving the abrasion resistance of polyester monofilaments, while still retaining their superior dimensional stability when compared to nylon, for example as in European Published Application 158,710, have not been completely successful. Similarly, improving the abrasion resistance of the nylon monofilament, for example, as disclosed in Canadian patent 1,235,249, does not permit one to overcome this restriction on nylon monofilament content as it does nothing to alleviate the known nylon dimensional instability. An alternative solution, which is concerned with the poor crimpability of nylon, is proposed in U.S. Pat. No. 4,709,732; however, this involves an increase in fabric weave complexity, and, as it does not address the dimensional instability, does not permit the nylon content to be increased.

Thus, a forming fabric containing both nylon and polyester monofilaments provides an acceptable compromise, provided the amount of nylon used is limited. Such fabrics also appear to be resistant to the pH which can be expected in use, which may range from about 4 to a value in the 8–9 range. Polyester fibers do not degrade unduly under these conditions, even under the ranges of temperature extending up to about 85° C. encountered in modern paper making machines.

It has also been proposed to improve the both the hydrolytic and abrasion resistance properties of monofilaments intended for use in papermaking fabrics. For example, International Patent Publication WO 83/01253 describes a low carboxyl content monoofilament for use in fabricating a paper machine dryer fabric. The monofilament allegedly provides improved resistance to hydrolytic degradation and abrasion, and is comprised of a polyester, preferably polyethylene terephthalate, a polyester stabilizer, preferably a polycarbodiimide known under the tradename STABAXOL, and a thermoplastic material, which is selected from the group consisting of polyurethanes and polyetherester block copolymers. According to the reference, the preferred thermoplastic material is poly-{butylene terephthalate-co-(multibutyleneoxy)terephthalate}, known under the tradename HYTREL. The document, however, provides no detail with respect to possible polyurethane materials other than to identify their reactants. It is simply stated that examples of compatible polymers with good abrasion resistance are polyurethanes produced by the reaction of methylene diphenyl isocyanate or tolylene diisocyanate with polyethylene adipate or phthalate or polyalkylene oxides. There is no identification of the materials used for the comparative tests leading to the results concerning loss of tensile strength under hydrolysis conditions and abrasion resistance. Desirable monofilament properties, such as dimensional stability and crimpability are not taught, and the lack of specificity of the blend components would not necessarily lead the skilled artisan to these properties. There is also no disclosure of the polyester and its intrinsic viscosity, nor is there any disclosure of the hardness of the thermoplastic ester- or ether-based polyurethane. In view of these deficiencies, it is impossible for even a skilled reader to repeat these experiments.

The present invention seeks to provide a solution to the problems associated with the use of nylon and other materials in a papermaker's forming fabric, by providing a monofilament based on a polymer blend which has the weaving and heat setting characteristics of polyethylene terephthalate. The abrasion resistance of fabrics in which at least a portion of the yarns are comprised of this blend also at least approaches the abrasion resistance capabilities of the common nylon-containing fabrics. For the remainder of the forming fabric it is preferred to use monofilaments of polyethylene terephthalate, but this invention is not limited to the use of this polymer for the remainder of the fabric, as other yarns or monofilaments could be used. Additionally, whilst in the following description this invention is discussed by way of reference to monofilaments as being the woven fibers, it is not so limited, and is applicable to forming fabrics woven from both yarns and monofilaments. It is preferred that the yarn used be a monofilament.

SUMMARY OF THE INVENTION

The present invention concerns a melt extruded monofilament having improved properties of abrasion resistance, wet-to-dry dimensional stability, and crimpability, which is particularly suitable for use in papermakers' forming fabrics, although the invention is not so limited. In its broadest aspect, this invention provides a monofilament formed from a blend consisting of from more than 60% to 90% by weight of polyethylene terephthalate, and from less than 40% to 10% by weight of a thermoplastic polyurethane, wherein the blend additionally contains from zero up to about 5% by weight of a hydrolysis stabilizer.

In a preferred embodiment, the melt extruded monofilament is comprised of a polymer blend consisting essentially of:

i) from 60 to 90 percent by weight of an essentially anhydrous polyethylene terephthalate having an intrinsic viscosity ranging from 0.50 to 1.20 when measured in a solvent comprising a 60:40 parts by weight mixture of phenol and 1,1,2,2-tetrachloroethane at 30° C., ii) from 10 to 40 percent by weight of an essentially anhydrous thermoplastic ester or ether based polyurethane having a Durometer Type A hardness not greater than 95, or a Durometer Type D hardness not greater than 75, and iii) from 0 to 5 percent by weight of a hydrolysis stabilizer.

Preferably, the Relative Abrasion Resistance of the melt extruded monofilament, as measured by the ratio of weight loss of monofilaments comprised of 100% polyethylene terephthalate as defined in i) above to the weight loss of monofilaments comprised of the blend, is from about 1.03 to about 2.67 when abraded by rotation in a slurry of 57% by weight No. 24 grit sand in water. In addition, the wet-to-dry dimensional stability of the invented melt-extruded monofilament is such that its length does not vary by more than from about 0.03% to about 0.10% when subjected to a cycle of wetting in boiling water and then drying out completely.

Preferably, the percentage range by weight of thermoplastic polyurethane in the polymer blend is above about 15%; more preferably it is from about 25% to about 35%; and most preferably the amount of thermoplastic polyurethane is about 30%.

In a further preferred embodiment, the intrinsic viscosity of the melt extruded monofilaments is at least about 0.735 when measured in a solvent comprising a 60:40 parts by weight mixture of phenol and 1,1,2,2-tetrachloroethane at 30° C. More preferably, the intrinsic viscosity of the melt extruded monofilament is at least about 0.78; most preferably, the intrinsic viscosity is at least about 0.82.

Papermakers' forming fabrics including monofilaments comprised of the polymer blend are woven from:

(a) at least one set of yarns woven in a first direction of the fabric, and (b) at least one set of yarns woven in a second direction of the fabric, substantially perpendicular to the first direction, which yarns include monofilaments formed from the polymer blend substantially as described above.

In this fabric in a preferred embodiment the yarns used in both the first and second direction are monofilaments, and it is also preferred that the yarns used in the first direction, together with the remainder of the yarns in the second direction, are polyethylene terephthalate. In a more preferred embodiment, the yarns comprising the major proportion of the face of the forming fabric and the minor proportion of the machine side of the fabric are monofilaments comprised of polyethylene terephthalate.

Utilization of the new monofilament of this invention in its broadest aspect is thus independent of the form of weave used. It encompasses those fabrics commonly known as single layer, double layer or duplex, and composite. Descriptions of these generic forming fabric types are provided, amongst other places, in U.S. Pat. Nos. 3,858,623 and 4,071,050 and in Canadian patent 1,115,177, respectively.

In the following description, it is to be understood that the term "machine direction" means a direction substantially parallel to the direction in which the forming fabric moves in the paper machine. Similarly, the term "cross-machine direction" means a direction substantially at a right angle to the "machine direction", and in the plane of the fabric. For a forming fabric which is not woven as a continuous loop but rather as an ordinary length of fabric (which is later joined to provide a continuous loop), "machine direction" corresponds to the warp threads, and "cross-machine direction" to the weft threads.

Quite surprisingly, it has been found that blends containing from 10% to at most 40% of polyurethane provide a monofilament which has abrasion resistance characteristics approaching those of a nylon monofilament, but without the other attendant problems of such a nylon monofilament deriving from its lack of permanent crimpability. Indeed, certain polyester—thermoplastic polyurethane blends exhibit better crimpability and heat set behaviour than those of the polyester when that polyester is used without any thermoplastic polyurethane in the monofilament. This property has a direct bearing on the weaving behaviour of these monofilaments, and is wholly unexpected. The use of this blended monofilament also allows further simplification of the weaving process, since it permits the elimination of the nylon monofilaments often used in the cross-machine direction to provide adequate abrasion resistance properties to the machine side of the fabric. In order to balance the known dimensional instability of the nylon in the presence of water, at best it can comprise alternate yarns in the weave; thus, a cross-machine yarns mix is not needed with the monofilament of this invention as the polyester—thermoplastic polyurethane blend monofilaments can be used alone as the only cross-machine yarns. This is of particular interest in complex multi-layer fabrics, wherein the polyester—thermoplastic polyurethane blend monofilament need only be used as the cross-machine yarn in the machine side of the fabric, as this is the surface exposed to most of the abrasion.

PREFERRED EMBODIMENTS OF INVENTION

For the blended monofilament, there are some necessary criteria which the polyester component must meet not only to provide a material which can be melt extruded into suitable monofilaments, but also to provide a polymer blend which has adequate properties. In addition to the standard requirements of purity, lack of "dirt", and particularly lack of water (the polyester should be relatively anhydrous with at most 0.007% of water) the polyester should also have a molecular weight similar to that of resins commonly used to provide warp and weft yarns. Thus the polyester should have an intrinsic viscosity of between 0.50 and 1.20 when measured in accordance with the procedure set forth below. Preferably, the intrinsic viscosity is in the range of from 0.65 to 1.05. Polyethylene terephthalate grades available under the following designation (which include trademarks) have this property:

MERGE 1934 (a trademark of Du Pont),

MERGE 1993 (a trademark of Du Pont), which is a polyethylene terephthalate grade identical to MERGE 1934 but with the addition of a processing aid and $TiO_2$ as colorant, ARNITE A06-300 (a trademark of Akzo), VITUF 9504C (a trademark of Goodyear), and TENITE 10388 (a trademark of Eastman).

As a guide only, it is believed that these preferred viscosities correspond to number average molecular weights in the range of from about $1.5\times10^4$ to about $5.2\times10^4$.

The intrinsic viscosity of the polyester component of the blend, and of the blended monofilament itself, when given herein, are measured on a solution of the polyester, or the polyester-thermoplastic polyurethane blend, in a mixed solvent comprising 60:40 parts by weight mixture of phenol and (1,1,2,2)-tetrachloroethane. The viscosity measurements are carried out at 30° C.

Turning now to the thermoplastic polyurethane part of the blend, it is again necessary that the material used be essentially anhydrous (less than 0.01% water), free from impurities as far as possible, and also free of "dirt", so that it can be processed by normal melt extrusion techniques into a monofilament. Generally, thermoplastic polyurethanes are of two types: those derived from polyesters, and those derived from polyethers. For the purposes of this invention, it has been found that the polyester variety is more effective, and hence is preferred.

Preferably, the thermoplastic polyurethane is a relatively soft material, the softness being measured in accordance with the standard procedure set forth in ASTM Method D-2240. The hardness should be no greater than 95 when measured with a Type A Durometer, or no greater than 75 when measured with a Type D Durometer.

Thermoplastic polyurethane grades available under the following designations (which include trademarks) have been found to be suitable for preparing the blended monofilaments of this invention:

Ester-based types:

TEXIN 445D, a trademark of Mobay, is an ester-based polyurethane made from 4,4'-methylene diphenyl diisocyanate, reacted with 1,4-butanediol (chain extender) to form the hard segment, and hydroxyl terminated poly(butylene 1,4-adipate). This material is identified by Chemical Abstracts Registry Number 26375-23-5 and has the following chemical formula: $(C_{15}H_{10}N_2O_2\text{-}C_6H_{10}O_4\text{-}C_4H_{12}O_2)_x$;

ELASTOLLAN C95, a trademark of BASF, is a polyurethane substantially as described in U.S. Pat. No. 3,689,443. This material is a substantially linear hydroxypolycaprolactone made from a hydroxy caprolactone and a glycol which are reacted substantially simultaneously with diphenylmethane- 4,4'-diisocyanate under conditions which produce a solid but remeltable and thermoplastically processable polyurethane. The lower molecular weight polycaprolactone and the glycol act as combined chain extenders;

PELLETHANE 2102-80A, a trademark of Dow Chemical, is an extrusion grade polycaprolactone-based polymer having nominal 80 Durometer A hardness. This material is identified by ChemicalAbstracts Registry Number 26354-06-3 and has the following chemical formula: $(C_{15}H_{10}N_2O_2\text{-}C_6H_2O_2\text{-}C_4H_{10}\ O_2)_x$;

Ether-based types:

TEXIN 990A, a trademark of Mobay, is an ether-based polyurethane similar to PELLETHANE 2103-80A;

PELLETHANE 2103-80A, a trademark of Dow Chemical, is an ether based polyurethane made from 4,4'-methylene diphenyl diisocyanate, 1,4-butanediol and polytetramethylene ether. It has a specific gravity of 1.13 (ASTM D-792), an ultimate tensile strength of $3.87\times10^6$ kg/m$^2$ (5,500 psi, ASTM D- 412), an ultimate elongation of 550% (ASTM D-412), and a melt index of 18 g/10 min (ASTM D-1238: 224° C., 1200 g).

This material is identified by Chemical Abstracts Registry Number 9018-04-6 and has the following chemical formula: $(C_{15}H_{10}N_2O_2\text{-}C_4H_{10}O_2(C_4H_{80})_nH_2O)_x$.

Under certain conditions, a hydrolysis stabilizer is necessary. If the papermaking machine is being operated at below temperatures of about 43° C. to about 48° C. then hydrolysis of the blended monofilaments of this invention is not a dominant consideration. Many papermaking machines operate at higher temperatures than this, up to about 85° C. At this order of temperature, hydrolysis stabilizers are necessary, as otherwise it appears that the blended fibers degrade more rapidly than is desirable. As will be shown below, it appears that it is the thermoplastic polyurethane which is being degraded, since tests have shown that although the tensile strength is only marginally being affected, the abrasion resistance decreases significantly.

The amount of stabilizer used can thus range from none at all, up to a maximum of about 5% of the total weight, beyond which no further improvement appears to be observed. Where a stabilizer is used, it seems that below about 0.3% the amount of protection given is minimal. We therefore prefer to use the stabilizer in a range of from about 0.3% to 5.0%, with a preferred range being from about 0.7% to about 3%. The stabilizer is conveniently incorporated into the blend by way of a "masterbatch" made up in either the thermoplastic polyurethane or the polyester. Commercially available stabilizers of the latter type which have been found to be successful are:

STABAXOL KE7646, a trademark of Rhein Chemie, which is a concentrate of 15% by weight of STABAXOL P-100 in 85% by weight of high intrinsic viscosity (0.95) polyethylene terephthalate (PET) and is manufactured and sold by Rhein Chemie of Rheinau, Germany.

STABAXOL P-100, a trademark of Rhein Chemie, is known by the chemical name triisopropylbenzene polycarbodiimide, identified by Chemical Abstracts Registry Number 29117-01- 9, and has the following chemical formula: $(C_{16}H_{22}N_2)_n$;

HYTREL 10MS, a trademark of Du Pont, is a concentrate of polycarbodiimide (PCD) and a hydrolysis stabilizer in a 40D grade of HYTREL polyester elastomer. It contains 20% PCD by weight. HYTREL 10MS is intended to be blended with unmodified HYTREL at a let-down ratio of 1:9 (i.e.: to yield a final level of 2% PCD) in order to improve the performance of HYTREL in hot, wet environments. HYTREL is a polyether-ester block copolymer having "soft" and "hard" segments. The "soft" segments are multibutyleneoxyterephthalate blocks, while the "hard" segments contain butylene terephthalate or tetramethylene terephthalate units.

In the preceding discussion, mainly for the sake of simplicity, the percentages given total to 100%. Generally speaking, the only other addition is a small amount, less than 0.5% by weight maximum, of a dye or pigment, such as $TiO_2$, to give the fiber a desired appearance.

It is also contemplated that the monofilaments can be surface coated as produced, for example with a combined antistatic agent and lubricant, to facilitate handling and weaving. Generally speaking, such coatings are removed very quickly when the fabric gets used in a papermaking machine.

EXAMPLES

Figure 1:
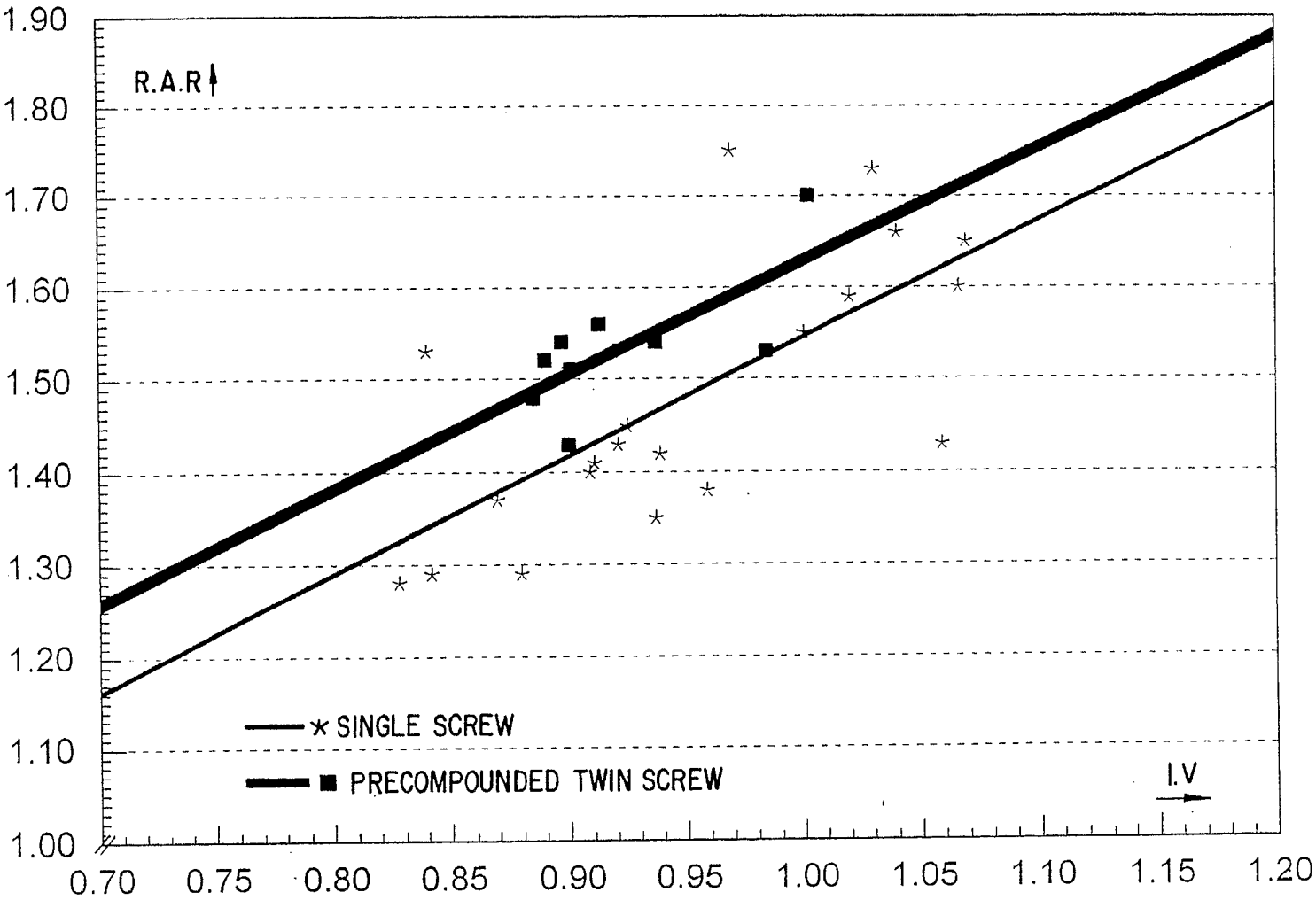
FIG. 1 shows in graphical form some of the data in Example I.

For brevity, in the following Examples the following abbreviations are used. The term "PET" is used to denote polyethylene terephthalate, and the term "TPU" is used to denote thermoplastic polyurethane. Where necessary, the TPU is identified as being ether-based or ester-based. The term "IV" is used to denote intrinsic viscosity, either of the polyester component or the PET-TPU blend itself. The term "RAR" is used to denote Relative Abrasion Resistance, a measure of the resistance of a monofilament to abrasion as measured against a chosen standard.

In most of the following Examples A1 through I11, the PET used was a Du Pont resin sold under the description "MERGE 1934" and post-condensed in the solid state. Where necessary, the PET is identified. Generally, this material was dried before use, and post-condensed in the solid state to ensure that the intrinsic viscosity is within the desired range. Similarly, the TPU material was also dried before use. In all cases, the nylon was nylon-66.

These Examples also utilize monofilaments prepared from the specified polymers. Where relevant, the dimensions of these monofilaments are given. Generally, the monofilaments used in forming fabrics will have a size within the range of from about 0.1 mm to about 0.9mm, and most often in the range of from about 0.127 mm to about 0.4 mm. It should also be noted that the monofilament is not necessarily of circular cross section, and particularly may be in the form of a rectangle or ribbon.

A. Monofilament Abrasion

To determine their abrasion resistance, lengths of monofilament strands comprised of the blend are initially weighed and then wound in a single layer around one end of a polyethylene rod. A polyester control monofilament is wound around the other end. The rod is then mounted on the lower end of a vertical shaft, at a right angle to it, so as to immerse the two windings in a slurry of 57% by weight of No. 24 grit sand in water. The shaft is rotated by a motor drive above the tank containing the slurry. After a predetermined time, the strands are removed from the slurry, unwound, dried and weighed. The time and shaft rotation speed are chosen to give measurable results. The weight loss of each of the samples after the test is then expressed as a percentage relative to the weight of each sample before the test.

Relative Abrasion Resistance (RAII) is a dimensionless number used to rank materials in order of their resistance to abrasion. For the purposes of this disclosure, the RAR is expressed as the ratio of the percent weight loss of the control monofilament to the percent weight loss of the sample monofilament under similar conditions. The RAR is thus calculated as follows:

$$\text{Relative Abrasion Resistance } (RAR) = \frac{\text{Percent Weight Loss of Standard}}{\text{Percent Weight Loss of Sample}}$$

An RAR value less than 1.00 denotes inferior abrasion resistance to the control, while an RAR greater than 1.00 denotes superior abrasion resistance to the control. Example A1 is used in this, and most further Examples, as the control sample against which the RAR is calculated.

The following results were obtained for PET-TPU blends by varying the TPU concentrations:

| Example Number | Monofilament Composition | Percent Weight Loss (%) | Relative Abrasion Resistance (RAR) |
|---|---|---|---|
| A1 | 100% PET control | 3.2 | 1.00 |
| A2 | 95% PET + 5% TPU | 3.4 | 0.94 |
| A3 | 85% PET + 15% TPU | 3.1 | 1.03 |
| A4 | 75% PET + 25% TPU | 2.4 | 1.33 |
| A5 | 65% PET + 35% TPU | 1.8 | 1.78 |
| A6 | 55% PET + 45% TPU | 1.1 | 2.91 |

This data shows that the abrasion resistance of monofilaments made from blends of PET and TPU is slightly better than PET when the TPU concentration is 15%, and becomes increasingly better as more TPU is added, up to a level of 45%. At this concentration, however, the monofilament becomes difficult to control during extrusion and becomes extremely soft, making it unsuitable for the weaving and heat setting of papermakers' forming fabrics. The TPU used in these experiments was TEXIN 445D.

The effect of stabilizer on improving the degradation resistance of the blended monofilaments is illustrated by the following results for a pH 4.0 solution:

| Example Number | Monofilament Composition | Exposure Conditions | Percent Weight Loss (%) | RAR |
|---|---|---|---|---|
| A1 | 100% PET control | 71° C. for 21 days | 3.2 | 1.00 |
| A7 | 64% PET + 36% TPU | 71° C. for 21 days | 2.3 | 1.39 |
| A8 | 64% PET + 36% TPU | 88° C. for 7 days | 2.3 | 1.39 |
| A9 | 64% PET + 36% TPU | 100° C. for 3 days | 2.7 | 1.19 |
| A10 | 62% PET + 37% TPU + 1% stabilizer | 71° C. for 21 days | 1.2 | 2.67 |
| A11 | 62% PET + 37% TPU + 1% stabilizer | 88° C. for 7 days | 1.2 | 2.67 |
| A12 | 62% PET + 37% TPU + 1% stabilizer | 100° C. for 3 days | 1.4 | 2.29 |

This data shows that the addition of stabilizer to the blend of PET and TPU results in a significant improvement in degradation resistance at all test temperatures. The stabilizer in this case was STABAXOL KE7646 and the TPU was TEXIN 445D.

The effect of stabilizer concentration on the abrasion resistance of the invented monofilament is shown in the following table:

| Example Number | Monofilament Composition | Exposure Conditions | Percent Weight Loss (%) | RAR |
|---|---|---|---|---|
| A1 | 100% PET Control | 100° C. for 3 days | 3.2 | 1.00 |
| A13 | 66% PET + 34% TPU | 100° C. for 3 days | 2.5 | 1.28 |
| A14 | 73.2% PET + 26% TPU + 0.8% stabilizer | 100° C. for 3 days | 1.9 | 1.68 |
| A15 | 71.8% PET + 26% TPU + 2.2% stabilizer | 100° C. for 3 days | 1.9 | 1.68 |

Both stabilizer blends have greatly improved degradation resistance but the higher concentration of stabilizer does not give any further improvement. In these examples, the TPU was PELLETHANE 2102-80AE and the stabilizer STABAXOL KE7646.

In another test, the effect of the stabilizer on the abrasion resistance of an unhydrolysed blend of 65% PET and about 35% TPU was investigated. The results are given in the following table:

| Example Number | Monofilament Composition | Percent Weight Loss (%) | RAR |
|---|---|---|---|
| A19 | 100% Polyester | 2.2 | 1.00 |
| A20 | 64% PET + 36% TPU | 1.2 | 1.83 |
| A21 | 62% PET + 37% TPU + 1% Stabilizer | 1.1 | 2.00 |

This data shows that the addition of stabilizer does not have any detrimental effect on abrasion resistance. In this experiment, the TPU was TEXIN 445D and the stabilizer, STABAXOL KE7646.

B. Fabric Abrasion

To measure the abrasion resistance of forming fabrics, a fabric sample is held under tension against the outer surface of a drum comprised of ceramic segments rotating in a horizontal plane. A jet of water is continuously applied to the entrance nip of the fabric on the drum so as to keep the fabric and ceramic surface wet.

The thickness of the fabric is measured at the beginning of the test and thereafter at predetermined times after exposure to the rotating ceramic segment surface. The loss of thickness is a measure of abrasion resistance.

A series of double layer fabric samples were woven with warps of 0.16 mm diameter at a mesh count of 59/cm. The bottom, or machine side set of wefts were woven using PET, alternating PET/nylon, and 75% PET/25% TPU blend. In each case the weft count was 51/cm. All of these samples were woven with a paper side weft diameter of 0.19 mm and a machine side weft diameter of 0.30 mm. All of the samples were heat set identically. The results of abrasion tests in which the machine side of the fabric was in contact with the drum are given in the following table:

| Fabric Thickness Loss (in Millimeters, mm) | | | | |
|---|---|---|---|---|
| Example Number | Time in Minutes | 100% PET Control | Alternating PET/Nylon 66 | 75% PET/25% TPU Blend |
| B1 | 30 | 0.0132 | 0.0147 | 0.0124 |
| B2 | 60 | 0.0165 | 0.0157 | 0.0142 |
| B3 | 105 | 0.0210 | 0.0180 | 0.0162 |

The results displayed in this table show that both the fabric comprised of alternating PET/nylon weft and the fabric comprised of the 75% PET/25% TPU blend weft have much better abrasion resistance than the fabric woven with PET weft. Moreover, the fabric with the PET/TPU weft is more abrasion resistant than the fabric with alternating PET/nylon.

In a second series of tests, the abrasion resistance of fabric samples containing blended monofilaments, having differing concentrations of PET and TPU, and woven in the bottom layer of a composite fabric, was measured. The upper mesh count was 25/cm, and the lower mesh count 12.5/cm. The rectangular-section upper and lower warps were 0.11 mm by 0.19 mm, and 0.19 mm by 0.38mm respectively. The wefts were PET monofilaments, with the upper weft having a diameter of 0.18mm and the lower weft having a diameter of 0.30 mm. A 0.14 mm PET weft binder strand or tie strand was used in all cases. The bottom layer of the fabric was in contact with the drum.

| Example Number | Monofilament Composition | Thickness Loss in Millimeters after 75 Minutes |
|---|---|---|
| B4 | 100% PET control | 0.0188 |
| B5 | 84% PET + 16% TPU | 0.0152 |
| B6 | 75% PET + 25% TPU | 0.0137 |
| B7 | 65% PET + 35% TPU | 0.0119 |
| B8 | Alternating PET/Nylon 66 | 0.0124 |

The TPU used in the above examples B1 to B8 was TEXIN 445D.

This data supports the findings of strand abrasion tests; namely, that the abrasion resistance of cloth woven with blended PET/TPU weft exhibits superior abrasion resistance to cloth woven with 100% polyester weft, and further that the abrasion resistance improves with increasing concentrations of polyurethane. The 65% PET/35% TPU sample is more abrasion resistant than the sample containing alternating strands of PET and nylon-66.

C. Wet-to-Dry Dimensional Stability

Forming fabrics are often subjected to cycles of drying and wetting. For example, they are delivered dry to the paper mill and become saturated with water shortly after the paper machine is run to make paper. During its life time, a forming fabric may be dried out several times at maintenance shutdowns or on weekends. A forming fabric with a large proportion of nylon monofilaments in the cross machine direction will then suffer from changes in width. In cases where the polyester and nylon monofilaments lie in two separate layers, the forming fabric will curl badly at the edges due to the differential expansion or contraction of the two layers. This behaviour limits the use of nylon monofilaments to 50% of the total cross machine direction filaments. In the great majority of forming fabrics, the use of nylon is limited to 25% of the total filaments in the fabric; that is, 50% of the machine side cross machine direction monofilaments being nylon and the remainder of the machine side monofilaments and all of the paper side monofilaments being PET. At 25% nylon content, the polyester monofilaments substantially prevent the nylon monofilaments, and the entire fabric, from expanding or contracting significantly under conditions of different water content.

The following table shows the length changes occurring in monofilaments made from nylon, polyester, and the blended monofilaments of this invention, when subjected to a cycle of wetting (boiling in water) and then drying out. Measurements of length were made at room temperature immediately after the wetting or drying.

| Example Number | Monofilament Composition | % Length Change Dry to Wet | % Length Change Wet to Dry |
|---|---|---|---|
| C1 | 100% Nylon-66 | −0.74 | +0.64 |
| C2 | 100% PET Control | −0.07 | +0.07 |
| C3 | 95% PET/5% TPU | −0.07 | +0.04 |
| C4 | 85% PET/15% TPU | −0.10 | +0.10 |
| C5 | 75% PET/25% TPU | −0.03 | +0.03 |
| C6 | 65% PET/35% TPU | −0.07 | +0.04 |
| C7 | 55% PET/45% TPU | −0.43 | +0.23 |

The TPU used in the above Examples was TEXIN 445D, and the PET was Du Pont MERGE 1934, post-condensed to an IV of 1.02.

These results clearly show the well-known difference in behaviour between nylon and polyester monofilaments. The results also show that the blended monofilaments of this invention are very stable. At 45% TPU content, the blended monofilament begins to suffer from dimensional instability.

D. Crimpability

A commonly used measure of crimpability of the weft strands in forming fabrics is the so-called crimp differential. The warp monofilaments in the final cloth tend to be straighter than the weft monofilaments which, to a degree, are simply bent over and under the warp monofilaments. The weft monofilaments therefore tend to lie proud of the warp monofilaments, particularly on the machine-side of the fabric. But if the weft is a very stiff monofilament, then it will tend to bend the warp monofilament and thus not lie so proud of the warp. By careful measurement of the cloth thickness, it is possible to determine how far the weft thread is out of the plane of the warp threads. This difference in the warp and weft planes is known as the crimp differential. As the crimpability of the weft monofilament increases, so also does the crimp differential, in any given weave construction.

Examples of the crimp differentials observed in samples of double layer cloth having identical weave construction, warp strands, mesh counts and heat setting history for different weft strands is given in the table below.

| Example Number | Description of Weft Strand | Crimp Differential (mm) |
|---|---|---|
| D1 | 0.30 mm PET | 0.014 |
| D2 | 0.30 mm PET alternating with 0.30 mm nylon | 0.012 |
| D3 | 0.30 mm 75% PET/25% TPU blend | 0.017 |

The data displayed in this table illustrates that PET/TPU blend monofilaments have very high crimpability compared to polyester, whereas nylon has lower crimpability. The blended PET and TPU were Du Pont MERGE 1934, post-condensed in the solid state, and TEXIN 445D, respectively.

E. Mechanical Stability

The mechanical stability of a forming fabric is assessed by measuring its resistance to stretching and narrowing.

A sample of cloth 25.4 mm long and 50 mm wide is mounted in an INSTRON (trademark) tensile tester. The load and elongation are recorded as the tension on the sample is increased from zero to 7.16 kg/cm. Stretch resistance is derived by measuring the slope of the load-elongation curve. This defines the elastic modulus of the cloth which, for forming fabrics, is typically from about 1,100 to about 2,000 kg/cm.

Narrowing resistance is measured on the same sample, mounted in an INSTRON tensile tester, except that the reduction in width is accurately determined as the sample tension is increased from zero to 7.16 kg/cm. A narrowing resistance factor is found by dividing the observed width change, expressed in percent, by the total increase in tension. Typical narrowing resistance factors for forming fabrics are 0.005%/kg/cm to 0.050%/kg/cm.

Thus, optimum mechanical stability is reflected by high values of the elastic modulus and low values of the narrowing resistance factor.

To assess the effect of weft materials on mechanical stability, three samples of a plain weave/plain weave fabric were woven, each having rectangular warps of 0.11 by 0.19mm, threaded at 25/cm in the upper weave, and rectangular warps of 0.19 by 0.38 mm, threaded at 12.5/cm in the bottom weave. Three different bottom layer wefts were woven at identical mesh counts and the resulting samples were heat set using identical conditions. The elastic moduli and narrowing resistance factors of the three samples are given in the table below. The data for samples E1 and E2 shows that nylon has an adverse effect on the elastic modulus and narrowing resistance factor of the cloth.

| Example Number | Monofilament Description | Heat setting tension (kg/cm) | Elastic modulus (kg/cm) | Narrowing resistance factors (kg/cm) |
|---|---|---|---|---|
| E1 | 0.3 mm PET weft | 5.37 | 1238 | 0.015 |
| E2 | 0.3 mm alternating PET and nylon 66 weft | 5.37 | 1091 | 0.035 |
| E3 | 0.3 mm alternating PET and nylon 66 weft | 6.26 | 1292 | 0.032 |

This behaviour of nylon is partially overcome by using higher heat setting tensions to force the nylon to higher levels of permanent crimp, as Example E3 illustrates. Note that the stretch resistance was improved by the higher heat setting tension, but the narrowing resistance factor was completely unaffected. The monofilaments comprising blends of PET and TPU are inherently more crimpable, and give an improvement in mechanical stability. This is shown by the data in the following table, which compares a fabric sample with 75% PET/25% TPU weft, woven and heat set identically to the samples described above, with Example E1, containing a PET-only weft.

| Example Number | Monofilament Description | Heat setting tension (kg/cm) | Elastic modulus (kg/cm) | Narrowing resistance factors (kg/cm) |
|---|---|---|---|---|
| E1 | 0.3 mm PET weft | 5.37 | 1,238 | 0.015 |
| E4 | 0.3 mm PET/TPU weft | 5.37 | 1,408 | 0.012 |

The PET used in these Examples was Du Pont MERGE 1934, post-condensed in the solid state, and the TPU was TEXIN 445D.

F. Chemical Resistance

In a papermaking environment, forming fabrics can be subjected to periodic cleaning which often involves harsh acidic conditions. This cleaning with strong acids has a deleterious effect on any nylon monofilaments in the forming fabrics, thus reducing the life of the fabric and negating the enhanced abrasion resistance derived from the presence of nylon in the fabric. Tests were conducted in which coils of nylon, polyester, and various PET/TPU blends were immersed in 30% hydrochloric acid at 25° C. for various exposure times. The nylon completely dissolved after 17 hours exposure, whereas the polyester and PET/TPU blends showed no detrimental effects after 222 hours exposure. This indicates that PET/TPU blends have greatly superior resistance to harsh acid cleaning solutions than nylon.

G. Polyester Molecular Weight

To determine whether the molecular weight of the polyester used in the blends has any effect on the abrasion resistance of the monofilament, two monofilament blends were extruded under identical conditions with the same polyurethane concentration, but with polyesters of different molecular weights, as measured by intrinsic viscosity (IV). The abrasion resistance of the monofilaments was then measured in the sand slurry test and the results are given in the following table:

| Example Number | Monofilament Composition | IV | Percent Weight Loss (%) | RAR (Ref. IV 1.02) | RAR (Ref. IV 0.65) |
|---|---|---|---|---|---|
| G1 | 100% PET Control | 1.02 | 2.8 | 1.00 | 1.11 |
| G2 | 100% PET Control | 0.65 | 3.1 | 0.90 | 1.00 |
| G3 | 75% PET/ 25% TPU | 1.02* | 1.9 | 1.47 | 1.63 |
| G4 | 75% PET/ 25% TPU | 0.65* | 2.1 | 1.33 | 1.48 |

*These IVs are for the polyester component of the blend only, not the PET/TPU blended strand.

From the data displayed in this table, it can be seen that when blended with TPU, the higher molecular weight PET provides a filament with a slightly better abrasion resistance than that of the lower molecular weight PET. Both filaments have significantly better abrasion resistance than the PET control monofilaments. Thus it appears that the molecular weight of the PET is not the critical factor in determining the abrasion resistance of PET/TPU blend monofilaments. The PET used in the above example was MERGE 1934; the TPU was TEXIN 445D.

H. Comparison of Ether-Based and Ester-Based TPU

To establish whether ester-based TPU provides any advantage over ether-based TPU from the standpoint of abrasion resistance, a series of blends were extruded under identical conditions, using the same molecular weight PET, having an IV of 1.02. The abrasion resistance of the monofilaments was then measured using the sand slurry test. The results are given in the following table:

| Example Number | Monofilament Composition | Percent Weight Loss (%) | RAR |
|---|---|---|---|
| H1 | 100% PET Control | 3.2 | 1.00 |
| H2 | 80% PET + 20% Ether-based TPU | 2.7 | 1.19 |
| H3 | 70% PET + 30% Ether-based TPU | 2.4 | 1.33 |
| H4 | 80% PET + 20% Ester-based TPU | 2.5 | 1.28 |
| H5 | 70% PET + 30% Ester-based TPU | 2.0 | 1.60 |

This data illustrates that for a given TPU concentration, the ester-based TPU gives better abrasion resistance than ether-based TPU. The ester-based TPU used was TEXIN 445D, and the ether-based TPU was TEXIN 990A. The PET was Du Pont MERGE 1934, which had been post-condensed in the solid state.

I. Monofilament Extrusion

The polyester—thermoplastic polyurethane blended monofilaments of this invention may be produced in either one or two processing stages, and extruded using either a single or twin screw extruder. A two stage process is preferred, wherein the polyester and thermoplastic polyurethane are intimately blended in a first or precompounding stage prior to final extrusion in a second stage. However, single stage processing using a single screw extruder is sufficient in instances where wider tolerances in the uniformity of the monofilament properties are acceptable. Where the end use of the blended monofilament is in papermakers' forming fabrics, a two stage process wherein the monofilament is extruded using a twin screw extruder provides a more uniform final product with a generally higher RAR, and hence is preferred.

To prepare the polymer blend components of this invention for extrusion, the PET and TPU resins, and the stabilizer masterbatch, are first dried separately in a Patterson-Kelly (trademark) vacuum dryer for between 6 and 12 hours at a temperature of from about 130° C. to about 200° C. under low vacuum conditions. The dried components are then gravimetrically mixed, loaded into the extruder hopper, and then precompounded using a twin screw extruder and formed into 3.175 mm diameter strands which are quenched in a cold water bath and cut into pellets. This first stage is a high throughput, short residence time process, carried out at relatively high temperature (261°–336° C.) and serves to intimately mix the polymer blend components prior to final extrusion.

In the second stage, the polymer blend pellets are dried at a temperature of from about 152° C. to about 168° C. for approximately 10 hours in a Patterson-Kelly (trademark) vacuum dryer under low vacuum conditions. This second drying process appears to increase the intrinsic viscosity of these polymer blend pellets, hence their molecular weight. Typical IV values of from about 1.02 to about 1.10 are measured in polymer blend pellets obtained after first stage precompounding. The intrinsic viscosity of these same pellets following second stage drying is observed to increase by about 25% to 30%, to values ranging from about 1.28 to about 1.41. However, following final extrusion, a significant drop in the intrinsic viscosity of the finished monofilaments is observed, typically to values ranging from about 0.735 to about 1.3 or higher. When the end use of the monofilaments is in papermakers' forming fabrics, it is preferred that the IV of the precompounded polymer blend pellets be as high as is practical so as to provide the finished monofilaments with a relatively high degree of abrasion resistance, or RAR, as will be explained in greater detail.

These re-dried polymer blend pellets are then extruded through an appropriately sized die into finished monofilaments using a twin screw extruder operating at temperatures of from about 240° C. to about 290° C. After exiting the die, the monofilaments are first quenched in a water bath, then drawn at elevated temperatures of up to 100° C. between a set of draw rolls to draw ratios of from 3.0:1 to 4.5:1, and optionally further drawn at a higher temperature of up to 250° C. to a maximum draw ratio of 6.5:1 and then allowed to relax up to about 30% maximum whilst heated in a relaxing stage. The finished cooled monofilaments are then wound onto spools.

We have found that the physical properties of the final blended monofilaments, when produced according to the two stage, twin screw extrusion process substantially as described above, are more uniform when these same properties are compared to those obtained from monofilaments produced using the single stage, single screw extrusion process. We have also found that, at equal values of polymer intrinsic viscosity, the Relative Abrasion Resistance of the final blended monofilament is increased when a two stage blending and extrusion process is used when compared to RARs obtained in similar monofilaments produced using a single stage, single screw extrusion process. Two stage, twin screw extrusion provides a finished monofilament whose physical properties, particularly with regard to Relative Abrasion Resistance, diameter uniformity, tensile break strength, and elongation at break, are more uniform throughout the length of the monofilament, and hence this process is preferred.

As previously mentioned, the aforementioned increase in intrinsic viscosity observed in the polymer blend pellets following second stage drying appears to play an important role in determining the Relative Abrasion Resistance of the final monofilament. We have found that there is a generally linear relationship between intrinsic viscosity and Relative Abrasion Resistance and that, generally speaking, as the intrinsic viscosity of the polymer blend increases, the Relative Abrasion Resistance of the finished monofilament increases as well.

When manufactured for use in papermakers' forming fabrics, it is preferred that the RAR of the finished monofilament (as compared to the unblended PET component) be greater than about 1.03; more preferably, the RAR is greater than about 1.3, and it is most preferred that the RAR of the finished monofilament be above about 1.4. The following table displays RAR and IV values obtained from nine finished monofilament samples labelled Examples I1 through I9. The IV values were measured in a solvent comprising a 60:40 parts by weight mixture of phenol and 1,1,2,2-tetrachloroethane at 30° C. As is apparent from this data, the highest RAR values are generally those obtained from monofilaments which have a correspondingly high intrinsic viscosity:

| Example No. | I1 | I2 | I3 | I4 | I5 | I6 | I7 | I8 | I9 |
|---|---|---|---|---|---|---|---|---|---|
| IV | 0.885 | 0.89 | 0.897 | 0.90 | 0.90 | 0.913 | 0.937 | 0.984 | 1.00 |
| RAR | 1.48 | 1.52 | 1.54 | 1.51 | 1.43 | 1.56 | 1.54 | 1.53 | 1.70 |

Thus, it is preferred that the intrinsic viscosity of the final polymer blend monofilament be at least about 0.735 as measured in a solvent as described above; more preferably, the intrinsic viscosity of the finished monofilament is at least about 0.78, and most preferably it is at least about 0.82. This will ensure that the RAR of the finished monofilament is sufficiently high so as to be useful in abrasive environments such as are encountered in papermaking operations. Where the end use of the monofilament is in applications where abrasion resistance is not a critical limiting factor, then the IV of the finished monofilament may be less than the preferred minimum values noted above.

The composition of all of the Examples I1 through I9 in the table above was as follows: 64% PET, 31% TPU and 5% STABAXOL KE7646. The PET was Du Pont MERGE 1993 and the TPU was PELLETHANE 2102-80A.

EXAMPLES I10 THROUGH I13

In the following Examples, data characterizing the physical properties of several monofilaments are presented. Example I10 is a 100% PET control monofilament produced in a single stage process using a single screw extruder. Example Ill is a polymer blend monofilament of the present invention manufactured in accordance with the preferred two stage, twin screw extrusion process previously described. Examples I12 and I13 are also polymer blend monofilaments, somewhat similar in composition to that of Example I11, but which were manufactured using a single stage, single screw extrusion method.

Example I11: A uniform mixture of pellets containing 64% by weight of Du Pont polyester resin MERGE 1993, post-condensed in the solid state to an IV of from 0.945 to about 0.965, 31% by weight of PELLETHANE 2102-80A thermoplastic polyurethane resin, having a Durometer hardness of 80 on the A scale, and 5% by weight of STABAXOL KE7646, was dried, mixed and extruded as a 3.175 mm diameter precompounded monofilament according to the first stage process previously described. The extrusion conditions, which are not considered limiting, were:

First Heater Zone Temperature: 93° C.

Second Heater Zone Temperature: 232° C.

Third Heater Zone Temperature: 288° C.

Fourth Heater Zone Temperature: 288° C.

Fifth Heater Zone Temperature: 249° C.

Sixth Heater Zone Temperature: 249° C.

Seventh Heater Zone Temperature: 249° C.

Extruder Die Temperature: 282° C.

The monofilament was then quenched in a cold water bath and chopped into pellets. These pellets were then dried according to the second stage procedure described earlier, loaded into a twin screw extruder and re-extruded using a 0.46 mm to 1.14 mm die at the same extrusion heater conditions noted above. The resulting monofilament was then quenched in a 60° C. water bath positioned 2.0 cm under the die. The quenched monofilament was drawn in a hot air oven at a temperature of from about 68° C. to about 80° C. at a draw ratio of 3.36:1, drawn further in a hot air oven at a temperature of 121° C. to a total draw ratio of 5.25:1, and then allowed to relax a maximum of 25% at a temperature of from about 249° C. to about 268° C. The finished monofilament was taken up on spools for testing.

Examples I12 and I13: Two comparable monofilaments to that described in Example I11 were prepared using a single pass, single screw extrusion process. The polymer blend of Example I12 was comprised of 73% by weight of Du Pont MERGE 1934 polyester, 26% by weight TEXIN 445D polyurethane, and 1% by weight of STABAXOL KE7646, a hydrolysis stabilizer. The polymer blend of Example I13 contained 67% by weight of Du Pont MERGE 1934 polyester, 28% by weight of PELLETHANE 2102-80AE polyurethane and 5% by weight of STABAXOL KE7646. In both Examples I12 and I13, the blend components were first dried under low vacuum conditions according to the procedure described in Example I11. The component pellets were gravimetrically mixed, then loaded into the extruder hopper and extruded into finished monofilaments using a single screw extruder in a single operation with no intermediate compounding or drying as in Example I11. The resulting monofilaments were quenched and then drawn substantially as described above.

A PET control monofilament, comprising 100% Du Pont MERGE 1934 PET, was also produced using the same single stage single screw extrusion conditions described above for the polyester-polyurethane blend of Examples I12 and I13. The physical properties of the four materials were tested and the results are given below:

| | Examples I10 through I13 | | | |
|---|---|---|---|---|
| Physical Property | Example I10: 100% Polyester Control | Example I11: 64% PET - 31% TPU - 5% Stabilizer (2 Stage Process) | Example I12: 73% PET - 26% TPU - 1% Stabilizer (1 Stage Process) | Example I13: 67% PET - 28% TPU - 5% Stabilizer (1 Stage Process) |
| Tensile Strength ($kg/m^2$) | $5.55 \times 10^7$ | $3.50 \times 10^7$ | $4.43 \times 10^7$ | $3.26 \times 10^7$ |
| Tensile Elongation (%) | 55.7 | 50.0 | 62.0 | 65% |
| Elastic Modulus ($kg/m^2$) | $0.70 \times 10^9$ | $0.62 \times 10^9$ | $0.63 \times 10^9$ | $0.56 \times 10^9$ |
| Shrinkage at 220° C. (%) | 10.5 | 28.0 | 8.3 | 10.0 |
| Percent Weight Loss (%) | 3.2 | 2.1 | 2.5 | 2.2 |
| Relative Abrasion Resistance (RAR) | 1.00 | 1.52 | 1.28 | 1.43 |

The RAR data displayed in the table above shows that the two stage, twin screw extrusion process provides a monofilament (Example I11) having a higher Relative Abrasion Resistance than comparable monofilaments produced using the single stage, single screw process (Examples I10, I12 and I13).

As previously noted, the uniformity of the physical properties of the polymer blend monofilaments of this invention is particularly important when their intended end use is in papermakers' forming fabrics. We have found that the properties of monofilaments produced according to the two stage twin screw process described herein are more uniform than those obtained from monofilaments produced using the single stage single screw extrusion process, particularly with regard to Relative Abrasion Resistance, strand diameter variation and tensile strength.

The graph displayed in FIG. 1 shows a series of data points obtained by plotting RAR as a function of the intrinsic viscosity of finished monofilaments produced according to both the single and twin screw methods. FIG. 1 shows that, for the majority of intrinsic viscosity measurements, a higher Relative Abrasion Resistance value is obtained from monofilaments produced according to the two stage twin screw process than from comparable monofilaments produced using the single stage single screw process. FIG. 1 also shows that the RAR data obtained from monofilaments produced according to the single stage single screw process is more randomly positioned on the graph, and hence exhibits a greater degree of variance, than the RAR values obtained from the two stage twin screw lots. It has also been our experience that other strand properties, in particular yarn diameter or size, tensile strength and knot properties, are subject to less variability when the monofilaments of this invention are manufactured according to the two stage twin screw process. Thus, for monofilament applications where it is important that the properties of the yarn be uniform, and where abrasion resistance is a dominant consideration, it is preferred to use the two stage, twin screw process. This process provides the finished monofilaments with higher RAR values, at given intrinsic viscosities, than comparable monofilaments extruded using the single stage, single screw process. The polymer blend used to produce all of the monofilament data shown in FIG. 1 was 65% PET, 30% TPU and 5% stabilizer. The PET was MERGE 1993, the TPU was PELLETHANE 2102-80A and the stabilizer was STABAXOL KE7646.

We claim:

1. A melt extruded monofilament having improved abrasion resistance, wet-to-dry dimensional stability, and improved crimpability, consisting essentially of a blend of:

i) from more than 60 to about 75 percent by weight of an essentially anhydrous polyethylene terephthalate having an intrinsic viscosity ranging from 0.50 to 1.20 when measured in a solvent comprising a 60:40 parts by weight mixture of phenol and 1,1,2,2-tetrachloroethane at 30° C., ii) from about 25 to less than 40 percent by weight of an essentially anhydrous thermoplastic ether- or ester-based polyurethane having a Durometer Type A hardness less than 95, or a Durometer Type D hardness less than 75, and iii) from 0 to about 5 percent by weight of a hydrolyric stabilizer, wherein the Relative Abrasion Resistance of the melt extruded monofilament as measured by the ratio of weight loss of monofilaments comprised of the unblended essentially anhydrous polyethylene terephthalate as defined in i) to the weight loss of monofilaments comprised of the blend is from about 1.19 to about 2.67 when wound in a single layer around one end of a polyethylene rod and abraded by rotation while immersed in a slurry of 57% by weight of No. 24 grit sand in water.

2. The monofilament of claim 1 wherein the polyurethane is present in the blend in an amount ranging from about 25 to about 35 percent by weight.

3. The monofilament of claim 1 containing no stabilizer.

4. The monofilament of claim 1 wherein the stabilizer is present in the blend in an amount ranging from about 0.3 to about 5 percent by weight.

5. The monofilament of claim 1 wherein the stabilizer is present in the blend in an amount of from about 0.7 to about 3 percent by weight.

6. The monofilament of claim 1 wherein the Relative Abrasion Resistance, as measured according to the method described, is from about 1.19 to about 2.28.

7. The monofilament of claim 1 wherein the intrinsic viscosity of the extruded monofilament, measured according to the method described for the polyethylene terephthalate component, is at least about 0.78.

8. The monofilament of claim 1 wherein the intrinsic viscosity of the extruded monofilament, measured according to the method described for the polyethylene terephthalate component, is at least about 0.82.

9. The monofilament of claim 1 wherein the polyurethane is present in the blend in an amount of about 30 percent by weight.

10. A melt extruded monofilament having improved abrasion resistance, wet-to-dry dimensional stability, and improved crimpability, consisting essentially of a blend of:

i) from more than 60 to about 75 percent by weight of an essentially anhydrous polyethylene terephthalate having an intrinsic viscosity ranging from 0.50 to 1.20 when measured in a solvent comprising a 60:40 parts by weight mixture of phenol and 1,1,2,2-tetrachloroethane at 30° C., ii) from about 25 to less than 40 percent by weight of an essentially anhydrous thermoplastic ether- or ester-based polyurethane having a Durometer Type A hardness less than 95, or a Durometer Type D hardness less than 75, and iii) from 0 to 5 percent by weight of a hydrolytic stabilizer, wherein:

a) the Relative Abrasion Resistance of the melt extruded monofilament as measured by the ratio of weight loss of monofilaments comprised of the unblended essentially anhydrous polyethylene terephthalate as defined in i) to the weight loss of monofilaments comprised of the blend is from about 1.19 to about 2.67 when wound in a single layer around one end of a polyethylene rod and abraded by rotation while immersed in a slurry of 57% by weight of No. 24 grit sand in water, and b) the percent length change occurring in the melt extruded monofilament when subjected to a cycle of wetting by boiling in water and then drying out is no greater 0.10%.

11. The monofilament of claim 1 wherein the polyurethane is present in the blend in an amount ranging from 25 to about 35 percent by weight.

12. The monofilament of claim 10 containing no stabilizer.

13. The monofilament of claim 10 wherein the stabilizer is present in the blend in an amount ranging from about 0.3 to about 5 percent by weight.

14. The monofilament of claim 21 wherein the stabilizer is present in the blend in an amount of from about 0.7 to about 3 percent by weight.

15. The monofilament of claim 10 wherein the Relative Abrasion Resistance, as measured according to the method described, is from about 1.19 to about 2.28.

16. The monofilament of claim 10 wherein the intrinsic viscosity of the extruded monofilament, as measured according to the method described for the polyethylene terephthalate component, is at least about 0.78.

17. The monofilament of claim 10 wherein the intrinsic viscosity of the extruded monofilament, as measured according to the method described for the polyethylene terephthalate component, is at least about 0.82.

18. The monofilament of claim 10 wherein the polyurethane is present in the blend in an amount of about 30 percent by weight.

19. A melt extruded monofilament having improved abrasion resistance, wet-to-dry dimensional stability, and improved crimpability, consisting essentially of a blend of:

i) from more than 60 to about 75 percent by weight of an essentially anhydrous polyethylene terephthalate having an intrinsic viscosity ranging from 0.50 to 1.20 when measured in a solvent comprising a 60:40 parts by weight mixture of phenol and 1,1,2,2-tetrachloroethane at 30° C., ii) from about 25 to less than 40 percent by weight of an essentially anhydrous thermoplastic ether- or ester-based polyurethane having a Durometer Type A hardness less than 95, or a Durometer Type D hardness Less than 75, and iii) from 0 to about 5 percent by weight of a hydrolyric stabilizer, wherein:

a) the Relative Abrasion Resistance of the melt extruded monofilament as measured by the ratio of weight loss of monofilaments comprised of the unblended essentially anhydrous polyethylene terephthalate as defined in i) to the weight loss of monofilaments Comprised of the blend is from about 1.19 to about 2.67 when wound in a single layer around one end of a polyethylene rod and abraded by rotation while immersed in a slurry of 57% by weight of No. 24 grit sand in water, b) the percent length change occurring in the melt extruded monofilament when subjected to a cycle of wetting by boiling in water and then drying out is no greater 0.10%, and c) the intrinsic viscosity of the melt extruded monofilament, as measured in a solvent comprising a 60:40 parts by weight mixture of phenol and 1,1,2,2-tetrachloroethane at 30° C., is at least about 0.735.

20. The monofilament of claim 19 wherein the polyurethane is present in the blend in an amount ranging from about 25 to about 35 percent by weight.

21. The monofilament of claim 19 containing no stabilizer.

22. The monofilament of claim 19 wherein the stabilizer is present in the blend in an amount ranging from about 0.3 to about 5 percent by weight.

23. The monofilament of claim 19 wherein the stabilizer is present in the blend in an amount of from about 0.7 to about 3 percent by weight.

24. The monofilament of claim 19 wherein the Relative Abrasion Resistance, as measured according to the method described, is from about 1.19 to about 2.28.

25. The monofilament of claim 19 wherein the intrinsic viscosity of the extruded monofilament as measured according to the method described, is at least about 0.78.

26. The monofilament of claim 19 wherein the intrinsic viscosity of the extruded monofilament as measured according to the method described, is at least about 0.82.

27. The monofilament of claim 19 wherein the polyurethane is present in the blend in an amount of about 30 percent by weight.

* * * * *